US008011569B2

(12) United States Patent
Foltz et al.

(10) Patent No.: US 8,011,569 B2
(45) Date of Patent: Sep. 6, 2011

(54) CABLE STORAGE AND DISPENSING SYSTEM

(75) Inventors: Christopher Thomas Foltz, Poughkeepsie, NY (US); Kanayo G. Okonji, Wappingers Falls, NY (US); Sreekanth Ramakrishnan, Wappingers Falls, NY (US); Eduardo M. Koster Abad, Poughkeepsie, NY (US); Eric A. Stegner, Durham, NC (US)

(73) Assignee: International Business Machines Corporation, Armonk, NY (US)

( * ) Notice: Subject to any disclaimer, the term of this patent is extended or adjusted under 35 U.S.C. 154(b) by 542 days.

(21) Appl. No.: 12/206,428

(22) Filed: Sep. 8, 2008

(65) Prior Publication Data

US 2010/0059618 A1 Mar. 11, 2010

(51) Int. Cl.
*G06F 17/00* (2006.01)

(52) U.S. Cl. ..... 235/375; 235/451; 235/492

(58) Field of Classification Search ..... 235/375, 235/451, 492

See application file for complete search history.

(56) References Cited

U.S. PATENT DOCUMENTS

| | | | | |
|---|---|---|---|---|
| 5,772,152 | A | 6/1998 | Maldonado | |
| 6,454,202 | B2 | 9/2002 | Ito | |
| 6,968,994 | B1 | 11/2005 | Smith | |
| 2007/0120684 | A1 | 5/2007 | Utaka et al. | |
| 2007/0190815 | A1 | 8/2007 | Sampson | |
| 2010/0224328 | A1 * | 9/2010 | Utaka et al. | 156/378 |

OTHER PUBLICATIONS

IBM TDB, Dollenmaye, WL, "Cable Storage Reel", IP.com, PriorArtDatabse, Dec. 1, 1963, p. 1-2.

* cited by examiner

*Primary Examiner* — Ahshik Kim
(74) *Attorney, Agent, or Firm* — Cahn & Samuels, LLP; Steven L. Bennett

(57) ABSTRACT

An embodiment of the invention provides a method for storing a cable, including receiving one or more cables on an adjustable central coil. An RFID chip connected to the cable is read via a RFID reader proximate the central coil. The cable is routed from the central coil to one or more adjustable middle coils, and routed from the middle coil to an adjustable outer coil. The cable is dispensed from the outer coil; and, the RFID chip is read via a RFID reader proximate the outer coil. The method modifies the distance between the central coil and the middle coil, the central coil and the outer coil, and/or the middle coil and the outer coil. Specifically, the diameter of the central coil, the middle coil, and/or the outer coil is adjusted. The modification accommodates for the arc limit and/or head size of the cable.

1 Claim, 8 Drawing Sheets

CABLE STORAGE AND DISPENSING SYSTEM

I. FIELD OF THE INVENTION

The present invention is in the field of methods, computer program products, and apparatuses for a cable storage and dispensing system.

II. BACKGROUND OF THE INVENTION

The information technology (IT) manufacturing environment involves many complex bills of materials with a large variety of sensitive components utilized for assembly. In a discrete manufacturing build model where these components are handled and plugged frequently and stored as work in process inventory, workmanship defects may arise due to component damage. Using six sigma techniques to identify quality detractors, a failure mode in this environment has been derived from the handling and management of cables. Whether it is sensitive pins in many cable heads or plastic connectors on Ethernet cables, there is significant potential for damage to these parts in a manufacturing environment.

Additionally, there are other issues associated with the management of cables. These cables are visually very similar in nature. Hence, there are instances wherein the "age" of the cable is discarded resulting in poor dispatching methodologies. The poor dispatching methods result in aging of these cables. Another source of defects in cables is caused by their 'over-bending' while coiling them for storage purposes.

III. SUMMARY OF THE INVENTION

An embodiment of the invention provides a method for storing a cable, including receiving one or more cables on an adjustable central coil. An radio frequency identification (RFID) chip connected to the cable is read via a RFID reader proximate the central coil. The cable is routed from the central coil to one or more adjustable middle coils, and routed from the middle coil to an adjustable outer coil. The cable is dispensed from the outer coil; and, the RFID chip is read via a RFID reader proximate the outer coil.

The method modifies the distance between the central coil and the middle coil, the distance between the central coil and the outer coil, and/or the distance between the middle coil and the outer coil. Specifically, the diameter of the central coil, the middle coil, and/or the outer coil is adjusted. The modification accommodates for the arc limit and/or head size of the cable.

IV. BRIEF DESCRIPTION OF THE DRAWINGS

The present invention is described with reference to the accompanying drawings. In the drawings, like reference numbers indicate identical or functionally similar elements.

V. DETAILED DESCRIPTION OF THE DRAWINGS

Exemplary, non-limiting, embodiments of the present invention are discussed in detail below. While specific configurations are discussed to provide a clear understanding, it should be understood that the disclosed configurations are provided for illustration purposes only. A person of ordinary skill in the art will recognize that other configurations may be used without departing from the spirit and scope of the invention.

At least one embodiment of the invention addresses the critical failure mode of damaged cables while providing value as an asset tracking tool. A process of using the system begins by attaching a cable system clamp, which is designed to protect the vulnerable cable head from damage. This clamp has an embedded RFID passive tag which will pass asset information to the system once the cable is inserted into the system. As described more fully below, cables are connected to one another, head to foot, via the magnetic attributes of the cable system clamp.

Once the cables have been fitted with their clamps, they are ready to be inserted into the system. The system allows the operator to insert the cable into an opening in the system via the magnetic attachment and the internal coils (also referred to herein as "cylinders") of the system and wind the cable into a safe storage position inside.

Figure 1:
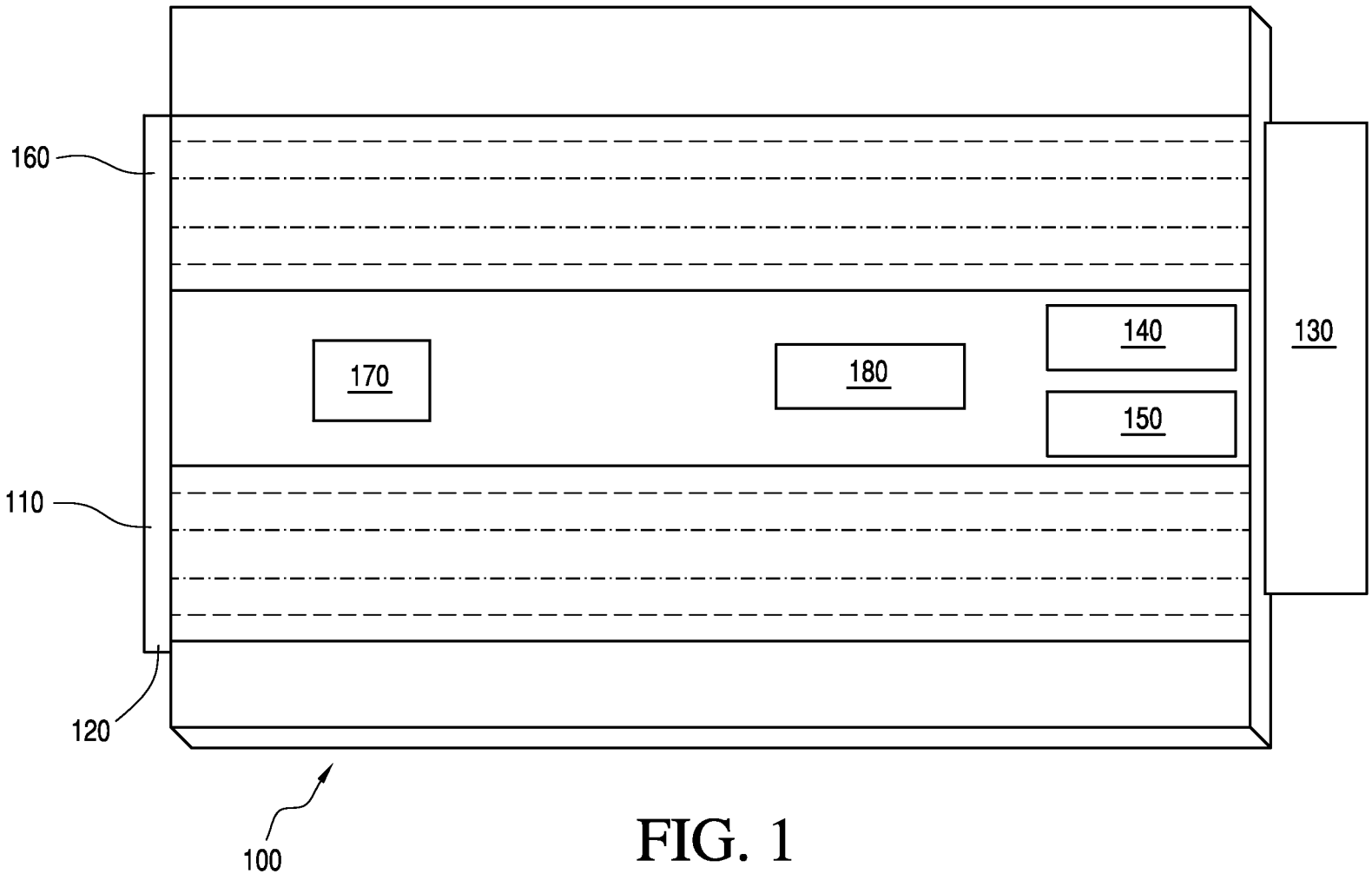
FIG. 1 is a schematic diagram illustrating a cable dispensing system according to an embodiment of the invention.

FIG. 1 is a schematic diagram illustrating the cable dispensing system 100 according to an embodiment of the invention. The system 100 includes an input (also referred to herein as the "cable receiving component") 110, one or more RFID readers 120, a motor 130, a cable insert button 140, a dispense button 150, an output (also referred to herein as the "cable dispensing component") 160, a counter 170, and a part number display 180. It is recognized that, in an alternative embodiment, the system 100 could lack a part number display 180. The passive RFID tags are inserted into the input 110 by pushing the cable insert button 140. As the RFID tags are passed into the system, the RFID reader 120 captures asset attributes, including quantity of cables stored inside (displayed on the counter 170 and part number display 180). Cables are coiled through the system and dispensed by pressing the dispense button 150, which pushes stored cables out of the system's exit 160, which also decrements asset data based on detection of a signal from an RFID tag on the clamp. The system 100 is powered via the motor 130. Clamps can be saved and reused to save cost, and the coiled storage methodology consolidates the space required for storing cables, saving line side factory floor space. The system provides a solution for cable protection, storage, and management while addressing the real business problems of cable damage and dispatching rule enforcement.

Different embodiments of the invention include at least one of the following: minimizing potential damage to cables and cable heads via clamps and an internal coil storage system, leveraging RFID technology to track inventory counts and valuable asset data on all cables stored in the system, and organizing and ordering a component that is commonly wrapped and stored on a shelf or hung on a rack. Further, different embodiments of the invention include automatic tracking and dispensing, which can make the process of counting and using cables for assembly an easy process, cable clamps that are reusable and are a more favorable cost and environmental solution than packaging used for storage (e.g., bubble wrap, electro static bags), and first-in-first-out (FIFO) rules can be enforced by ensuring that the first cable stored in the system is the first cable dispensed.

Figure 2:
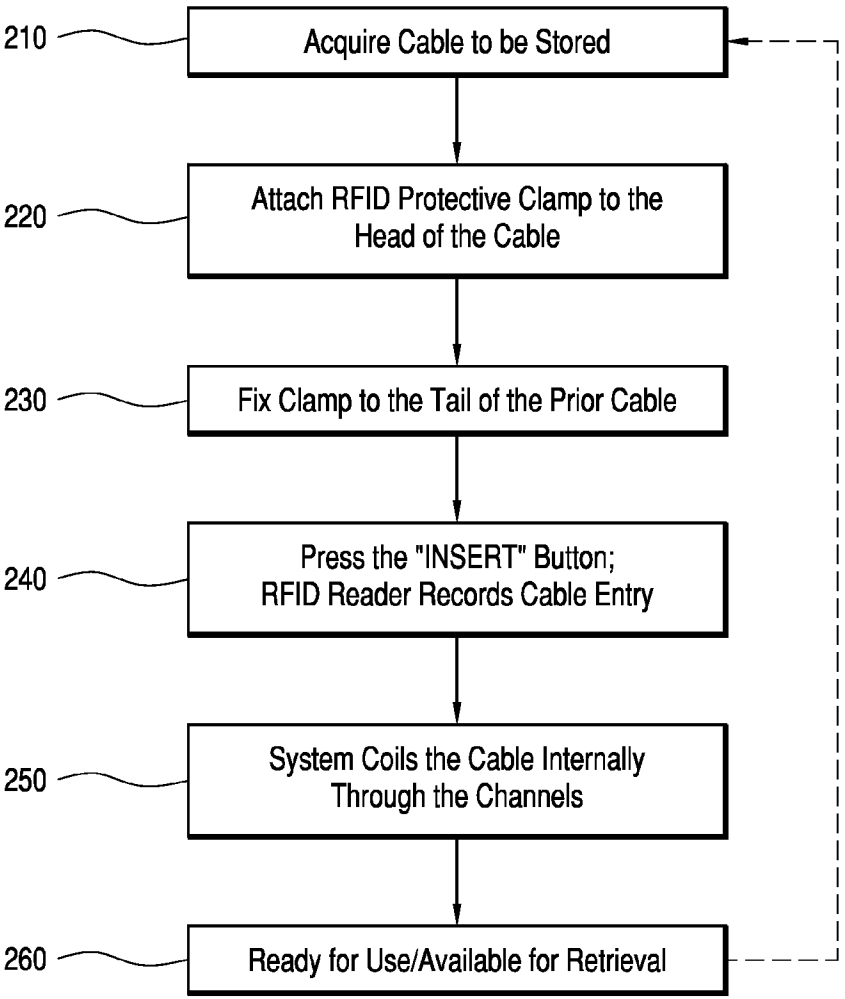
FIG. 2 is a flow diagram illustrating a process to insert cables into the system according to an embodiment of the invention.

FIG. 2 is a flow diagram illustrating a process to insert cables into the system according to an embodiment of the invention. The cable to be stored is acquired (210). In order to insert a cable to the system, the cable is first attached with the RFID enabled protective clamp to the "head" of the cable (220). Then, this end of the clamp is attached to the clamp on the tail of the previous cable (230). The "INSERT" button on the front of the system is pressed and the new cable is gradually inserted (240). The magnetic ends of the cable clamps cause the head of the new cable to attach itself to the tail of the last available cable clamp in the system. Simultaneously, the RFID-reader detects the new cable that was added and increments the counter accordingly. The "INSERT" button is held until the cables are in a locked position. There are numerous concentric cylinders over which these cables coil through in the system (250). These concentric cylinders enable storing a larger number of cables by increasing the overall surface areas. Also, these cylinders are spaced in such a way that the clamps and the cables do not tangle between themselves or get stuck in the coils. In one embodiment, the cables coil around the outer cylinders first and go towards the inner ones. The cables are dispensed through these inner ones to enable FIFO (260). In an embodiment of the invention, the part number display is incremented by one to reflect the addition of a cable.

Figure 3:
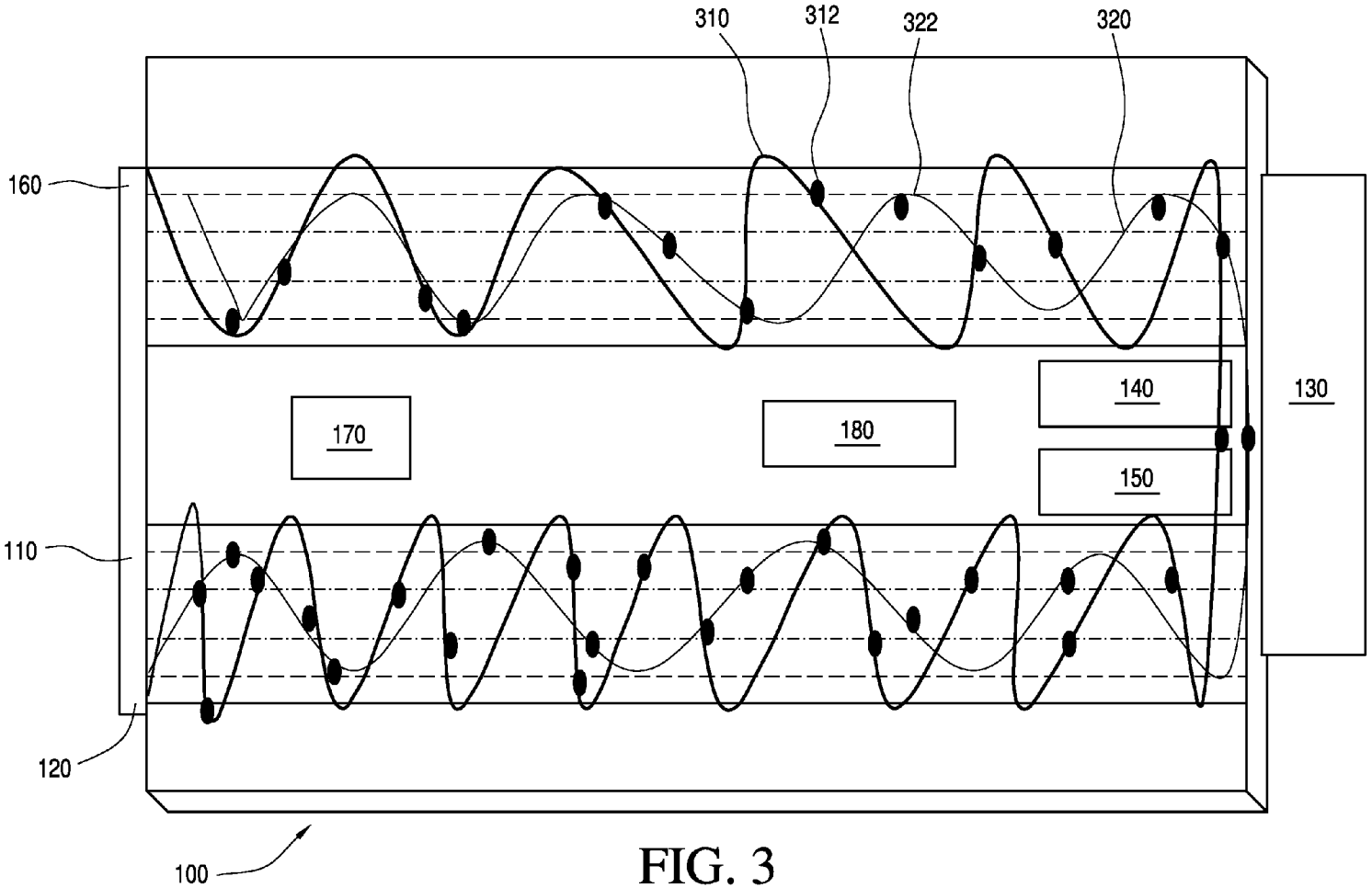
FIG. 3 is a schematic diagram illustrating cables stored in the cable dispensing system according to an embodiment of the invention.

FIG. 3 is a schematic diagram illustrating cables stored in the cable dispensing system according to an embodiment of the invention. Specifically, a cable 310 that is on the outermost coil is shown having clamps 312 in the locked position. Once the outer coil is completely filled, the next coil is initiated with loading the cables. A cable 320 on the second outer-most coil is shown having clamps 322. The process is continued until the counter hits a pre-specified limit or when the system capacity is full.

Figure 4:
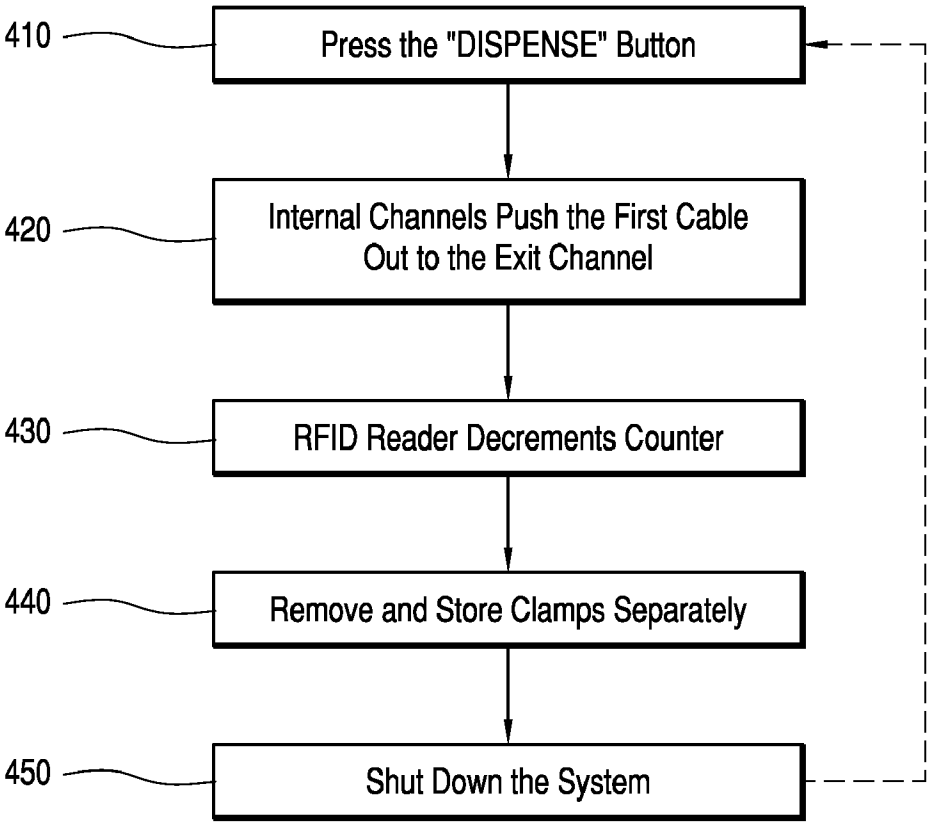
FIG. 4 is a flow diagram illustrating a process for retrieving cables according to an embodiment of the invention.

FIG. 4 is a flow diagram illustrating a process for retrieving cables according to an embodiment of the invention. For retrieving a cable from the system, the process involves pressing the "DISPENSE" button (410). When this happens, the inner most coil is initiated and the first cable present in the coil is pushed out to the exit channel (420). When the required cable is available at the exit window, the RFID reader records the transaction and decrements the count from the system counter (430). The magnetic clamps are gradually removed from the cable upon dispensing. Once the clamps are removed, the cable is sent for use in the manufacturing process, whereas the clamps are stored for re-use (440).

Figure 5:
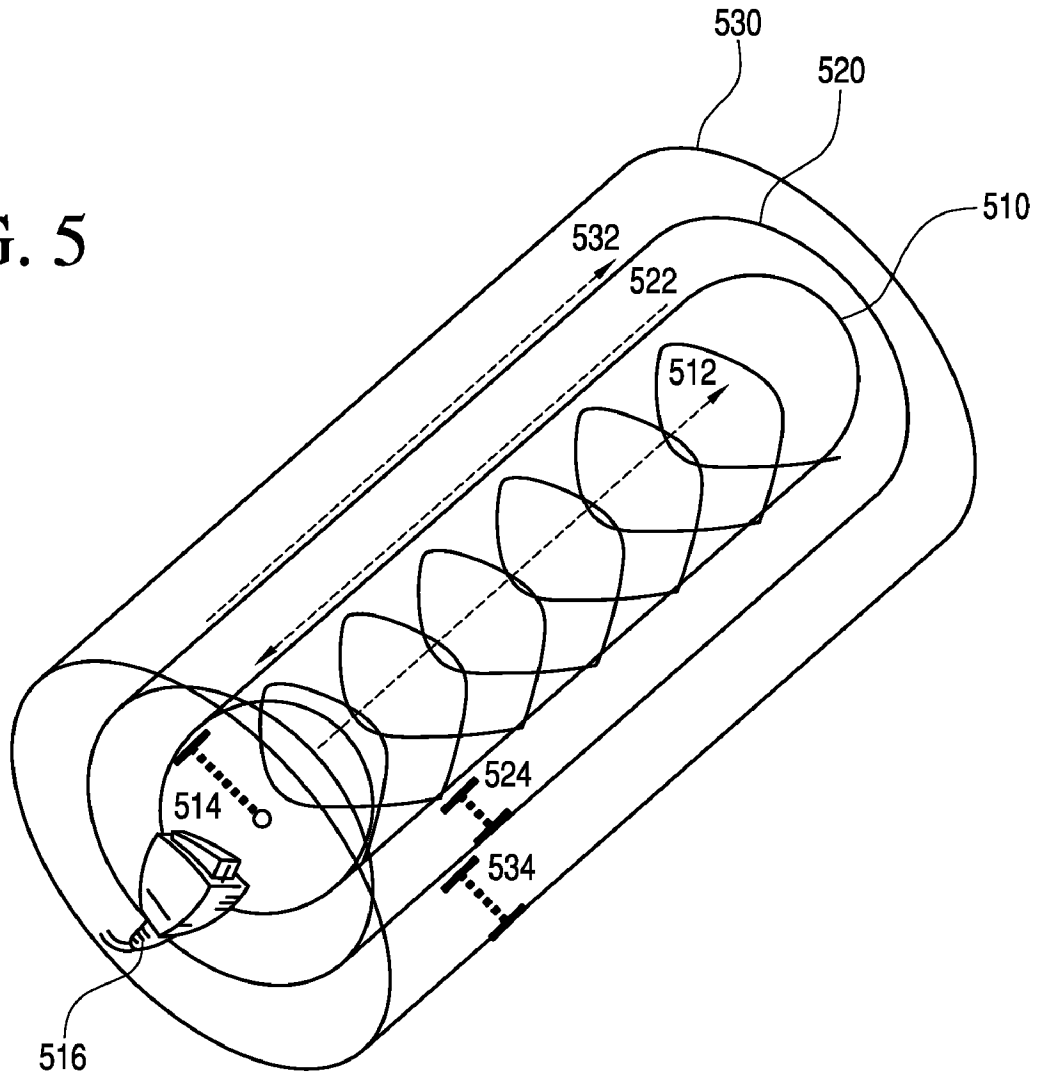
FIG. 5 illustrates an internal coil design according to an embodiment of the invention.

FIG. 5 illustrates an internal coil design according to an embodiment of the invention. A central coil 510 is positioned within a middle coil 520. The middle coil 520 is positioned within an outer coil 530. The internal concentric coils 510 and 520 wrap/store cables and provide an increased overall surface area for wrapping the cables, thereby consolidating space. The coils 510-530 are built from flexible material. Threads on the coils 510-530 (not shown) keep the cables aligned and route them towards the rear of the system. The consecutive coils threads alternate in directions. Thus, the system alternates directions to feed cables to the rear and front of the dispenser. Specifically, the central coil 510 has a central routing direction 512 to direct cables towards the middle coil 520. The middle coil 520 has a middle routing direction 522, opposite the central routing direction 514, to direct the cables towards the outer coil 530. The outer coil 530 has an outer routing direction 532 that is opposite the middle routing direction 524. In one embodiment of the invention, the system could include only one coil.

In one embodiment, a cable head 516 is first inserted into the center coil threads. Upon entry, the RFID reader (not shown) transmits cable attributes to the system, which automatically adjusts the radius of the center coil 510 to the arc limits of the cable. The cable is routed from the center coil 510 to the middle coil 520 (alternating direction) and eventually to the outer coil 530. The distance between the coils automatically adjusts per the arc limit and head size of the cable, for example, using pneumatic and/or hydraulic springs. Alternating routing returns the cable to the user for dispensing. Specifically, the central coil 510 has an adjustable radius 514, which helps control the distance 524 between the middle coil 520 and the central coil 510. The distance 534 between the outer coil 530 and the middle coil 520 can also be modified.

Equation (1) provides the total surface area available on the coil (SA1), wherein $r_c$=radius of the coil and h=the length of the coil.

$$SA1=2\Pi r_c h \quad (1)$$

The total surface area of each cable (SA2) is shown in Equation (2), wherein $r_d$=radius of the cable, l=the length of the cable, and θ=the arc limit of the cable on a cylindrical coil.

$$SA2=1\Pi r_d l\theta \quad (2)$$

If the total surface area available on the coil equals the total surface area of each cable (i.e., SA1=SA2), then the radius of the coil $(r_c)=(r_d \cdot l \cdot \theta)/h$.

Figure 6:
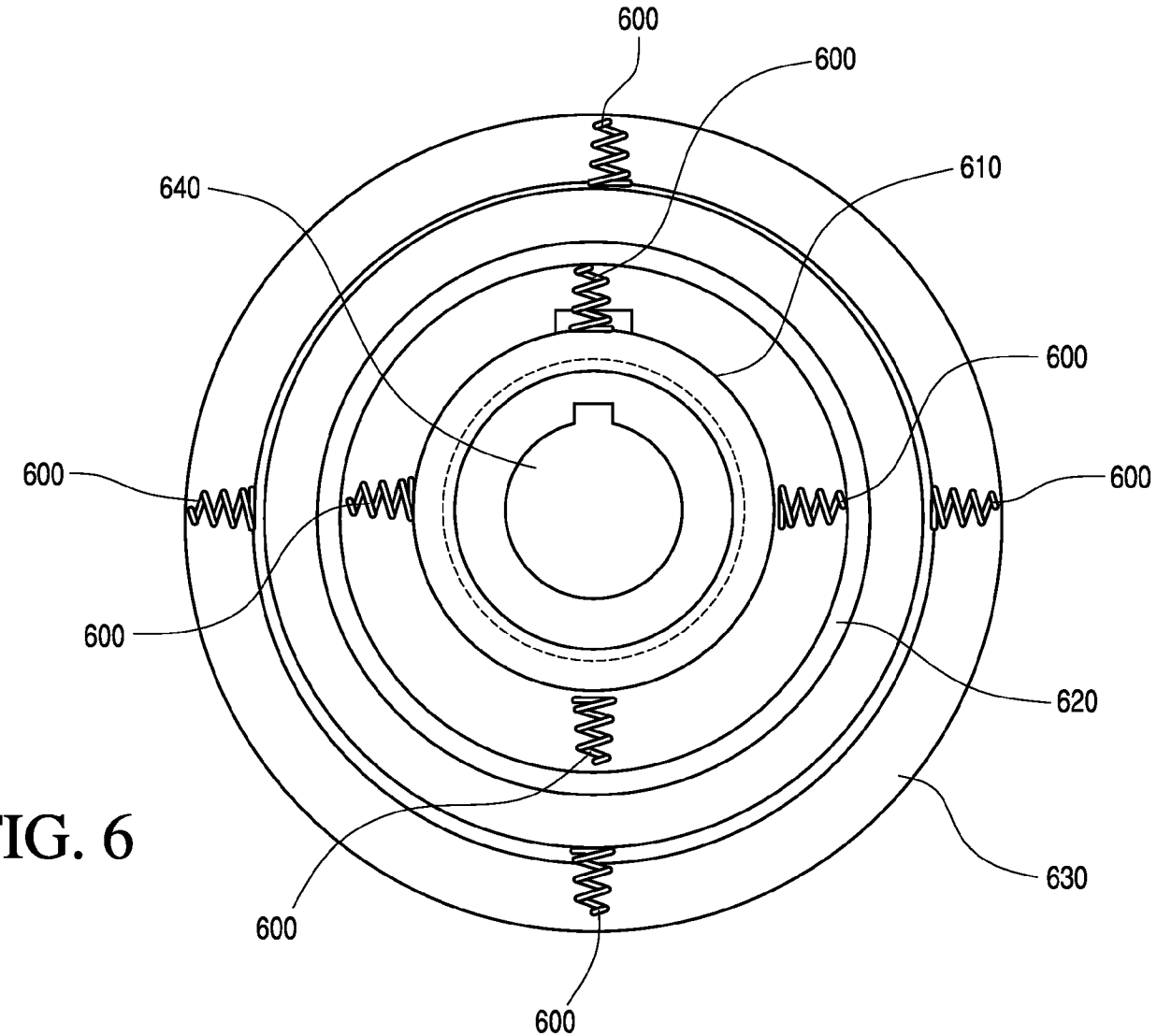
FIG. 6 illustrates a gear design for the concentric coils according to an embodiment of the invention.

FIG. 6 illustrates a gear design for the concentric coils according to an embodiment of the invention, wherein the system includes springs 600, such as helical springs, to adjust the diameters of a central coil 610, a middle coil 620, and an outer coil 630. A gear keyway 640 is positioned within the central coil 610, wherein force may be applied to the gear keyway using a lever to adjust the diameters of coils 610-630.

Figure 7:
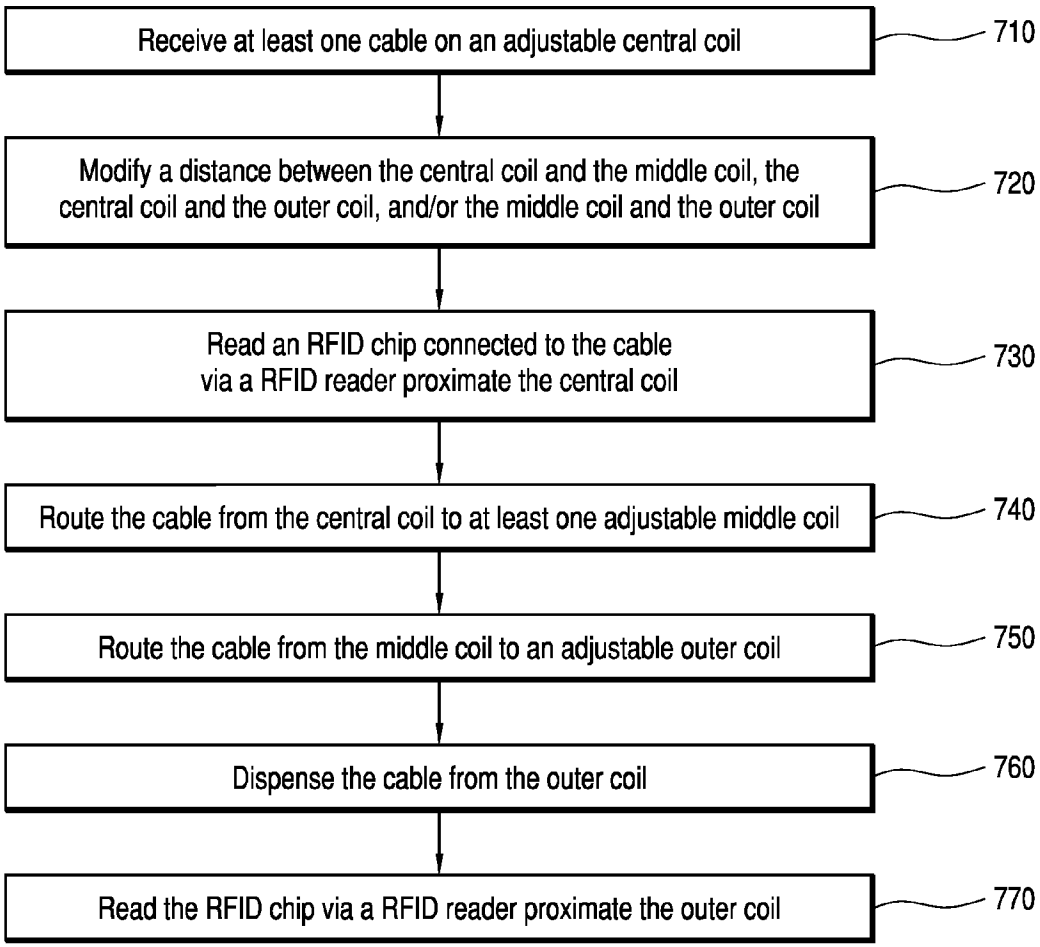
FIG. 7 is a flow diagram illustrating a method for storing and dispensing at least one cable according to an embodiment of the invention.

FIG. 7 is a flow diagram illustrating a method for storing and dispensing at least one cable according to an embodiment of the invention, wherein a cable is received on an adjustable central coil (710). An RFID chip connected to the cable is read via an RFID reader proximate the central coil (720). The distance between the central coil and the middle coil, the central coil and the outer coil, and/or the middle coil and the outer coil is modified (730). The modification adjusts the diameter of the central coil, the middle coil, and/or the outer coil. The modification accommodates for the arc limit and/or head size of the cable. The cable is routed from the central coil to at least one adjustable middle coil (740); and, the cable is routed from the middle coil to an adjustable outer coil (750). The cable is dispensed from the inner coil (760); and, an RFID reader proximate the outer coil reads the RFID chip (770).

Accordingly, an embodiment of the invention provides a storage and dispensing apparatus having a flexible central coil, one or more flexible middle coils, and a flexible outer coil. The central coil has a first adjustable diameter and a first outer surface for receiving one or more stored cables. The central coil also has a cable receiving component. The middle coil has a second adjustable diameter and a second outer surface for receiving the stored cable. The central coil is positioned within the middle coil. The outer coil has a third adjustable diameter and a third outer surface for receiving the stored cable. The middle coil is positioned within the outer coil. The outer coil has a cable dispensing component; and, the cable receiving component and/or the cable dispensing component has an RFID reader.

At least one embodiment of the invention can take the form of an entirely hardware embodiment, an entirely software embodiment or an embodiment including both hardware and software elements. In a preferred embodiment, the invention is implemented in software, which includes but is not limited to firmware, resident software, microcode, etc.

Furthermore, at least one embodiment of the invention can take the form of a computer program product accessible from a computer-usable or computer-readable medium providing program code for use by or in connection with a computer or any instruction execution system. For the purposes of this description, a computer-usable or computer readable medium can be any apparatus that can comprise, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk —read only memory (CD-ROM), compact disk—read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output (I/O) devices (including but not limited to keyboards, displays, pointing devices, etc.) can be coupled to the system either directly or through intervening I/O controllers. Network adapters may also be coupled to the system to enable the data processing system to become coupled to other data processing systems or remote printers or storage devices through intervening private or public networks. Modems, cable modem and Ethernet cards are just a few of the currently available types of network adapters.

Figure 8:
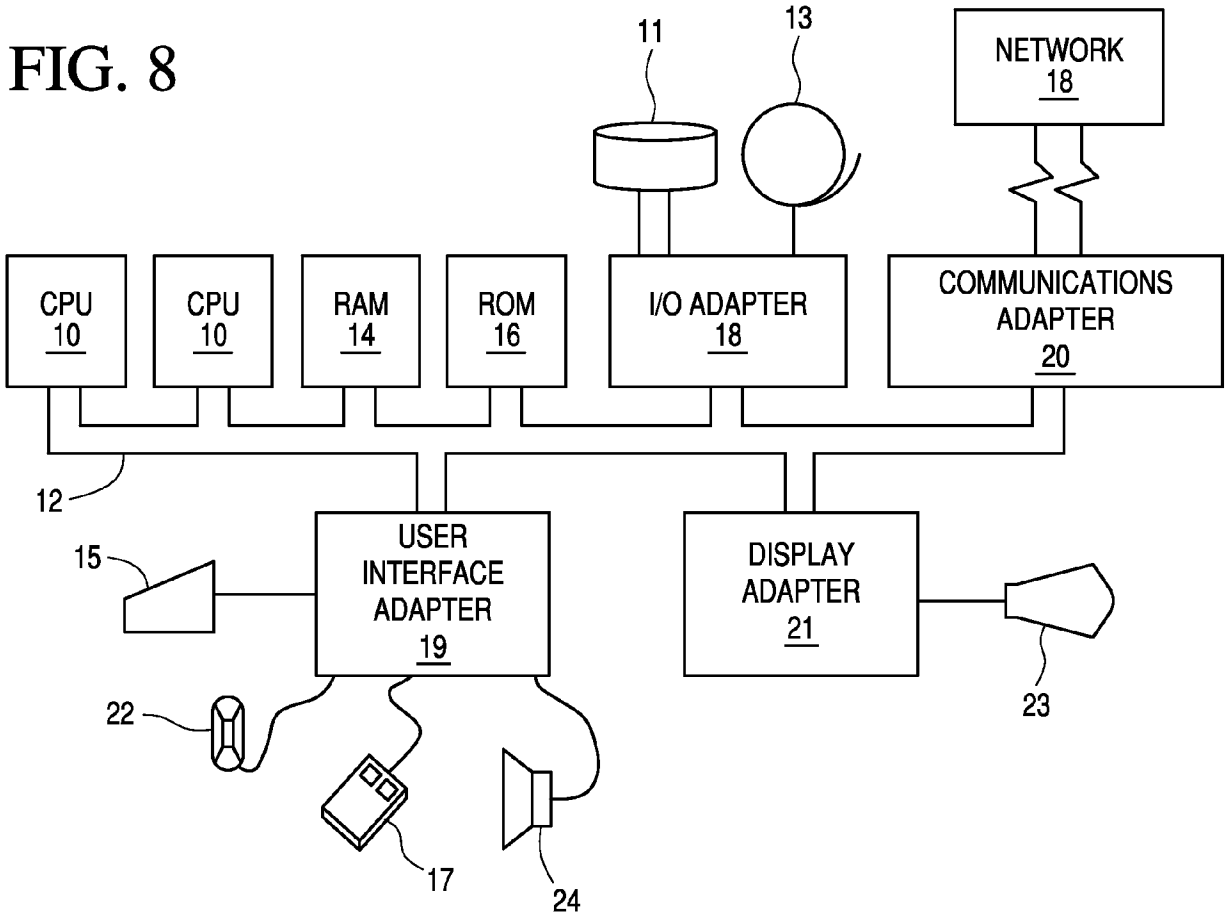
FIG. 8 illustrates a computer program product according to an embodiment of the invention.

A representative hardware environment for practicing at least one embodiment of the invention is depicted in FIG. 8. This schematic drawing illustrates a hardware configuration of an information handling/computer system in accordance with at least one embodiment of the invention. The system comprises at least one processor or central processing unit (CPU) 10. The CPUs 10 are interconnected via system bus 12 to various devices such as a random access memory (RAM) 14, read-only memory (ROM) 16, and an input/output (I/O) adapter 18. The I/O adapter 18 can connect to peripheral devices, such as disk units 11 and tape drives 13, or other program storage devices that are readable by the system. The system can read the inventive instructions on the program storage devices and follow these instructions to execute the methodology of at least one embodiment of the invention. The system further includes a user interface adapter 19 that connects a keyboard 15, mouse 17, speaker 24, microphone 22, and/or other user interface devices such as a touch screen device (not shown) to the bus 12 to gather user input. Additionally, a communication adapter 20 connects the bus 12 to a data processing network 25, and a display adapter 21 connects the bus 12 to a display device 23 which may be embodied as an output device such as a monitor, printer, or transmitter, for example.

Accordingly, the present invention provides monitoring control point conversions for translation component objects. A method according to one embodiment of the invention interfaces to a network and provides gateway protocol translation functions that enable sensor data, routed with the system network, to be translated and enriched using specialized metadata. The method provides personalized and secured access to the system being monitored and supports alerts and real time queries of the system. A protocol translation engine is provided that enriches the data using metadata that translates between proprietary protocols and common pervasive protocols.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means plus function elements in the claims below are intended to include any structure, or material, for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

We claim:

1. A method for storing a cable, comprising:

receiving at least one cable on an adjustable central coil;

reading a radio frequency identification (RFID) chip connected to said cable via a RFID reader proximate said central coil;

routing said cable from said central coil to at least one adjustable middle coil;

routing said cable from said middle coil to an adjustable outer coil;

dispensing said cable from said outer coil;

reading said RFID chip via a RFID reader proximate said outer coil; and modifying at least one of a distance between said central coil and said middle coil, said central coil and said outer coil, and said middle coil and said outer coil, wherein said modifying comprises adjusting a diameter of at least one of said central coil, said middle coil, and said outer coil, and wherein said modifying comprises accommodating for at least one of an arc limit and a head size of said cable.

* * * * *